US012305500B2

(12) United States Patent
Rodney

(10) Patent No.: US 12,305,500 B2
(45) Date of Patent: May 20, 2025

(54) SYSTEM AND METHOD FOR IDENTIFYING INCLINATION AND AZIMUTH AT LOW INCLINATIONS

(71) Applicant: Halliburton Energy Services, Inc., Houston, TX (US)

(72) Inventor: Paul F. Rodney, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 801 days.

(21) Appl. No.: 16/757,753

(22) PCT Filed: Dec. 14, 2017

(86) PCT No.: PCT/US2017/066482
§ 371 (c)(1),
(2) Date: Apr. 20, 2020

(87) PCT Pub. No.: WO2019/117925
PCT Pub. Date: Jun. 20, 2019

(65) Prior Publication Data
US 2021/0189861 A1 Jun. 24, 2021

(51) Int. Cl.
*E21B 47/024* (2006.01)

(52) U.S. Cl.
CPC ..... *E21B 47/024* (2013.01)

(58) Field of Classification Search
CPC ..... E21B 7/024
See application file for complete search history.

(56) References Cited

U.S. PATENT DOCUMENTS

| | | | | |
|---|---|---|---|---|
| 6,438,495 | B1 | 8/2002 | Chau et al. | |
| 6,633,816 | B2 | 10/2003 | Shirasaka et al. | |
| 9,062,528 | B2 | 6/2015 | Mitchell et al. | |
| 2002/0059734 | A1 | 5/2002 | Russell | |
| 2007/0030007 | A1 | 2/2007 | Moore | |
| 2008/0275648 | A1 | 11/2008 | Illfelder | |
| 2012/0048618 | A1* | 3/2012 | Zamanian | E21B 47/024 175/24 |
| 2014/0163888 | A1* | 6/2014 | Bowler | G06F 30/20 703/2 |

(Continued)

FOREIGN PATENT DOCUMENTS

| | | | |
|---|---|---|---|
| WO | 2000000786 | A1 | 1/2000 |
| WO | 2008147505 | A1 | 12/2008 |

OTHER PUBLICATIONS

International Search Report and Written Opinion dated Sep. 13, 2018, for the PCT application PCT/US2017/066482 filed on Dec. 14, 2017.

*Primary Examiner* — Dany E Akakpo
(74) *Attorney, Agent, or Firm* — K&L Gates LLP

(57) ABSTRACT

A downhole tool and method for identifying the inclination and/or azimuth of the downhole tool at low inclinations or unknown inclinations. The downhole tool is connectable to a tubing in a wellbore and comprises a magnetic field sensor operable to measure a magnetic field parameter in the wellbore. The downhole tool also comprises a controller operable to determine an orientation parameter for the downhole tool located in the wellbore using the magnetic field parameter, a dip angle for the magnetic field parameter, and a selected inclination value.

19 Claims, 10 Drawing Sheets

(56) References Cited

U.S. PATENT DOCUMENTS

| | | | | |
|---|---|---|---|---|
| 2014/0166363 | A1* | 6/2014 | Haci | E21B 47/024 175/24 |
| 2014/0367170 | A1 | 12/2014 | Hoehn et al. | |
| 2016/0290117 | A1 | 10/2016 | Dykstra | |

* cited by examiner

SYSTEM AND METHOD FOR IDENTIFYING INCLINATION AND AZIMUTH AT LOW INCLINATIONS

BACKGROUND

Directional wellbore operations, such as directional drilling, involve varying or controlling the direction of a downhole tool (e.g., a drill bit) in a wellbore to direct the tool towards a desired target destination. Various techniques have been used for adjusting the direction of a tool string in a wellbore. For example, slide drilling employs a downhole motor and a bent housing to deflect the wellbore. In slide drilling, the direction of the wellbore is changed by using the downhole motor to rotate the bit while drill string rotation is halted and the bent housing is oriented to deflect the bit in the desired direction.

In contrast to slide drilling systems, rotary steerable systems allow the entire drill string to rotate while changing the direction of the wellbore. By maintaining drill string rotation. An example of a tool for controlling deflection in a rotary steerable system (i.e. a rotary steerable tool) includes a drill bit on a shaft that rotates with the drill string and a housing surrounding the shaft that includes pads that extend or retract to apply a direction to the shaft. This is referred to as a push-the-bit rotary steerable tool. Another example of a rotary steerable tool employs a bent shaft that is held geostationary by rotating the bent shaft counter to the rotation of the drill string. Similar to slide drilling, the bent shaft is oriented to deflect the bit in the desired direction. This is referred to as a point-the-bit rotary steerable tool. By orienting the shaft, the direction of the drill bit is changed.

Directional systems require information to orient the downhole tool toward the desired destination. A slide drilling system must determine the orientation of the bent housing, while a rotary steerable system must determine the orientation of the housing surrounding the shaft. Consequently, the downhole tool generally includes one or more sensors that provide tool orientation information to a control system. The control system uses the orientation information to steer the tool.

BRIEF DESCRIPTION OF THE DRAWINGS

Embodiments of the invention are described with reference to the following figures. The same numbers are used throughout the figures to reference like features and components. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
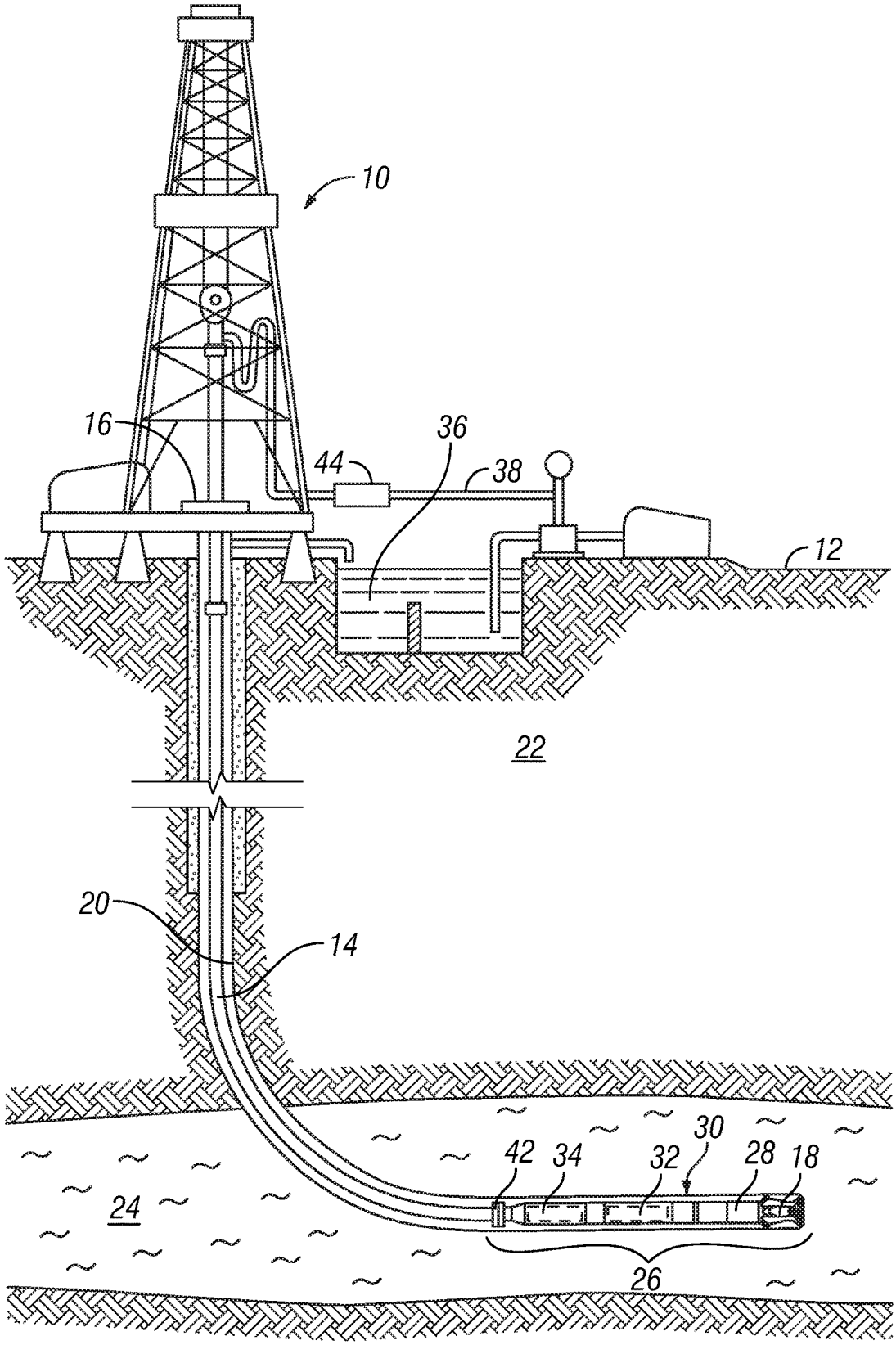
FIG. 1 depicts an elevation view of a well system, according to one or more embodiments.

FIG. 1 shows an elevation view of a well system, according to one or more embodiments of the present disclosure. The well system comprises a drilling rig 10 at the surface 12, supporting a tubing string 14. In some embodiments, the tubing string 14 may be a drill string comprising an assembly of drill pipe sections which are connected end-to-end through a work platform 16. In other embodiments, the tubing string 14 may also comprise coiled tubing rather than individual drill pipe sections. A drill bit 18 is coupled to the lower end of the tubing string 14, and through drilling operations creates a wellbore 20 through earth formations 22 and 24. The tubing string 14 has on its lower end a bottom-hole assembly (BHA) 26 that includes the drill bit 18, a drilling assembly 28 (e.g., a rotary steerable tool or a turbine drilling tool employed while sliding), a controller 30 built into a collar section 32, sensors 34, and a telemetry device 42.

Drilling fluid is pumped from a pit 36 at the surface through the line 38, into the tubing string 14 and to the drill bit 18. After flowing out through the face of the drill bit 18, the drilling fluid rises back to the surface through the annular area between the tubing string 14 and the wellbore 20. At the surface the drilling fluid is collected and returned to the pit 36 for filtering. The drilling fluid is used to lubricate and cool the drill bit 18 and to remove cuttings from the wellbore 20.

The controller 30 controls the operation of the telemetry device 42 and orchestrates the operation of downhole components. The controller processes data received from the sensors 34 and produces encoded signals for transmission to the surface via the telemetry device 42, which may transmit and receive signals in the form of mud pulses transmitted within the tubing string 14. Mud pulses may be detected at the surface by a mud pulse receiver 44. Other telemetry systems may be equivalently used (e.g., acoustic telemetry along the drill string, wired drill pipe, etc.). In addition to the downhole sensors 34, the system may include a number of sensors at the surface of the rig floor to monitor different operations (e.g., rotation rate of the drill string, mud flow rate, etc.).

Figure 2:
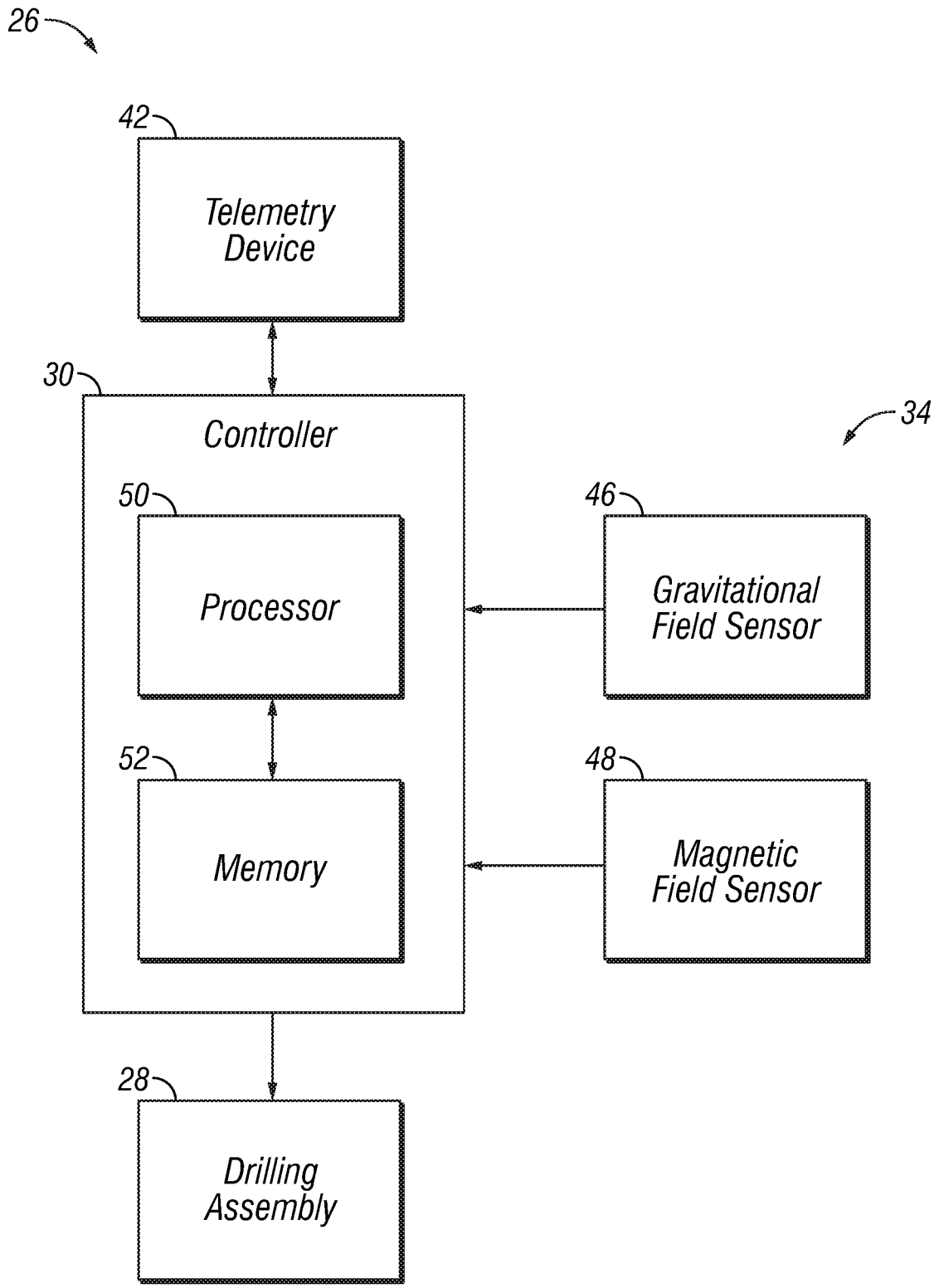
FIG. 2 depicts a block diagram view of a bottom-hole assembly (BHA), according to one or more embodiments.

FIG. 2 shows a block diagram view of the BHA 26 for conducting a survey of the wellbore, according to one or embodiments. The controller 30 may steer the BHA along a pre-defined wellbore trajectory using the drilling assembly 28 and the survey measurements from the sensors 34. The drilling assembly 28 is designed to drill directionally with continuous rotation of the drill string from the surface. The drilling assembly 28 may include a point-the-bit rotary steerable tool, which uses a bent housing to orient the drill bit, or a push-the-bit rotary steerable tool, which uses pads that engage the wellbore to orient the drill bit.

The controller 30 includes one or more processors 50 and memory 52 (e.g., ROM, EPROM, EEPROM, flash memory, RAM, a hard drive, a solid-state disk, an optical disk, or a combination thereof) capable of executing instructions to identify the orientation of the BHA and steer the BHA in a desired location using the drilling assembly 28. Software stored on the memory 52 controls the operation of the BHA 26 including the sensors 35 and the drilling assembly 28. As shown, the controller 30 may be positioned in the wellbore with the BHA 26. However, one skilled in the art would appreciate that the controller 30 may also be located at the surface to process the measurements made the by sensors 34 and steer the BHA 26.

The controller 30 receives measurements from the sensors 34 and determine an orientation of the BHA 26 relative to the Earth's magnetic and gravitational fields. The controller 30 then uses the orientation to determine a direction for the BHA 26 to drill along a pre-planned wellbore trajectory. The sensors 34 include a gravitational field sensor 46 and a magnetic field sensor 48. The gravitational field sensor 46 includes a tri-axial accelerometer, and the magnetic field sensor 48 includes a tri-axial magnetometer. The tri-axial accelerometer measures three independent components of the earth's gravity vector G including any disturbances, and the tri-axial magnetometer measures three independent components of the earth's magnetic field B including any disturbances. Thus, there are six independent measurements available at any time provided by the sensors 34, and each such set of measurements may be referred to as a survey.

Figure 3:
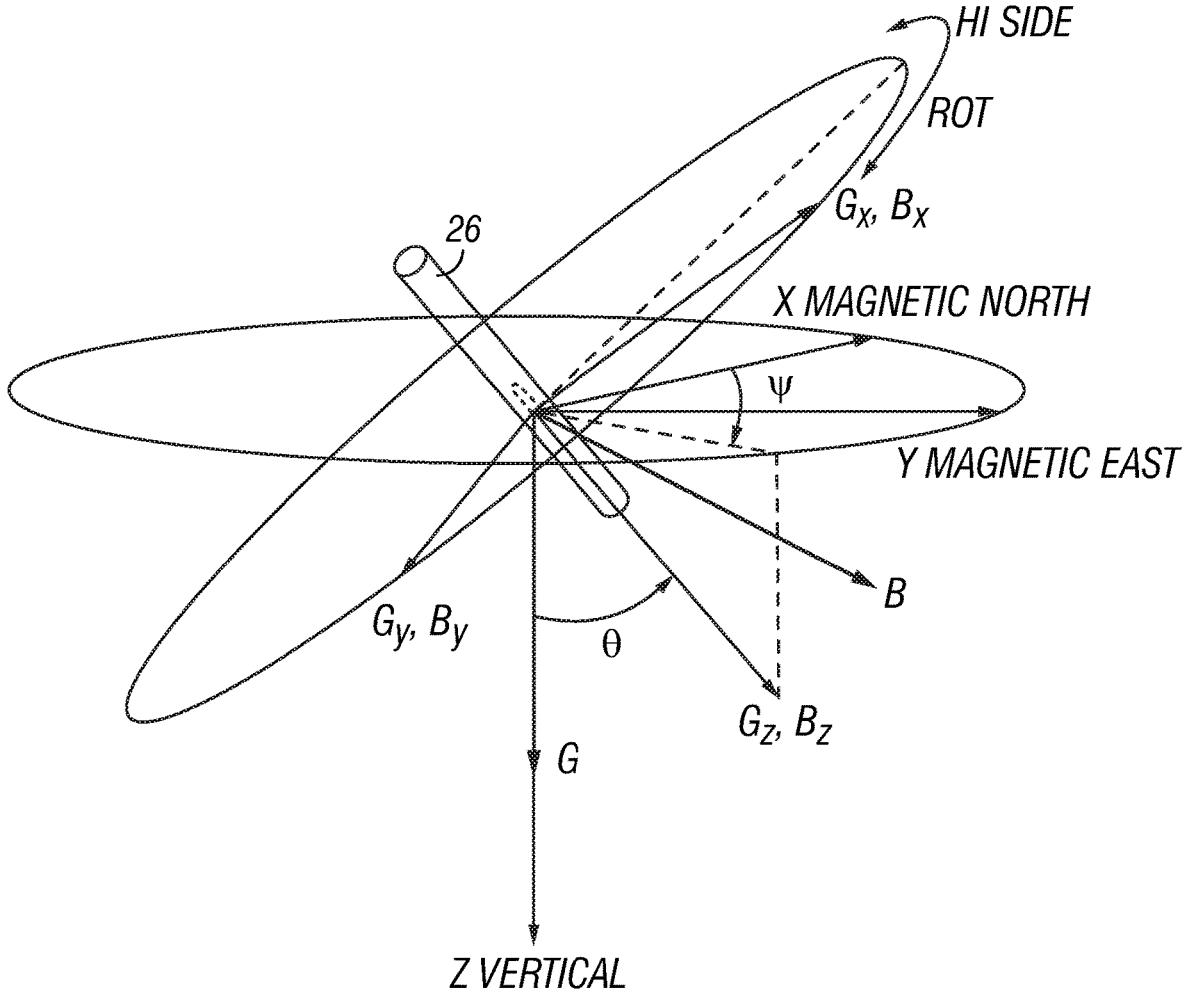
FIG. 3 depicts a coordinate system used for a wellbore survey, according to one or more embodiments.

FIG. 3 shows an example coordinate system for the measurements of the sensors 34, in accordance with one or more embodiments. The local axes x, y, z form a right handed coordinate system with the z-axis pointing in the direction of the drilled wellbore 20, and the x-axis is aligned with BHA 26 to a position on the pipe known as the tool face. The accelerometer and magnetometer axes are aligned along the x, y and z axes. The sensors 34 are calibrated to produce a positive reading when the component of gravity or magnetic field measures points along the corresponding axes. The accelerometers produce a vector of measurements, $G_{meas}=(G_x, G_y, G_z)$, and the magnetometers produce a vector of flux measurements $B_{meas}=(B_x, B_y, B_z)$. A right-handed Earth coordinate system X, Y, and Z is also depicted in FIG. 3, where Z points down into the Earth and is aligned with the Earth's gravity vector and X points to Magnetic North. It should be appreciated that the Earth's gravity vector may not be orthogonal to Magnetic North, but rather the Earth's magnetic field may have a dip angle Δ relative to a horizontal reference plane, such as a horizontal plane intersecting the Earth's gravity vector. The directional survey is used to calculate the wellbore azimuth ψ, the wellbore inclination θ, and the tool face rotation ROT from the high side of the hole. As depicted, the azimuth ψ is relative to Magnetic North, and the inclination θ is relative to the vertical component of the Earth's gravity vector.

The inclination θ at a point within the wellbore may be determined based on measurements made with the tri-axial accelerometer. Equations (1) and (2) are available for calculating the inclination, θ, of the drill string at the point at which the three components of acceleration are measured with the tri-axial accelerometer:

$$\theta = \mathrm{ArcTan}\left[\frac{\sqrt{Gx^2+Gy^2}}{Gz}\right] \tag{1}$$

$$\theta = \mathrm{ArcCos}\left[\frac{Gz}{\sqrt{Gx^2+Gy^2+Gz^2}}\right]$$

$$Gt = \sqrt{Gx^2+Gy^2+Gz^2} \tag{2}$$

$$Goxy = \sqrt{Gx^2+Gy^2}$$

where Gt is the total value of the gravitational field (i.e., the magnitude of the gravitational field vector) and where Goxy is the cross-axial component of the gravitational field. For small errors in Gx, Gy, and Gz (δGx, δGy, δGz), respectively, the error δθ in θ using equation (1) is given by $$\delta\theta = \frac{1}{1+\mathrm{Tan}[\theta]^2}\left(\frac{Gx\delta Gx}{\sqrt{Gx^2+Gy^2}\,Gz} + \frac{Gy\delta Gy}{\sqrt{Gx^2+Gy^2}\,Gz} - \frac{\sqrt{Gx^2+Gy^2}\,\delta Gz}{Gz^2}\right)$$

The error can be rewritten as $$\delta\theta = \frac{1}{Gt}\left(\frac{Gx*\mathrm{Cot}[\theta]}{Gt}\delta Gx + \frac{Gy*\mathrm{Cot}[\theta]}{Gt}\delta Gy - \mathrm{Sin}[\theta]\delta\mathrm{Gz}\right)$$

Expressing Gx and Gy in terms of Gt, inclination θ, and the gravitational tool face angle φ (the gravitational tool face angle is the angle between the survey tool's X-axis and the high side of a vertical plane tangent to the axis of the survey tool), the following expression is given:

$$\delta\theta=(-\delta Gx*\mathrm{Cos}[\theta]*\mathrm{Cos}[\phi]+\delta Gy*\mathrm{Cos}[\theta]*\mathrm{Sin}[\phi]-\delta Gz*\mathrm{Sin}[\theta])/(\sqrt{Goxy^2+Gz^2})$$

The errors associated with Eq. (1) are acceptable for stationary measurements, but for dynamic measurements, the variations in Gx and Gy can well exceed Gt. Thus, for dynamic inclination measurements, Eq. (1) may be avoided, especially at small inclinations where cos(θ) approaches 1.

To simplify the expression for the errors, Eq. 2 may be rewritten in the form given by $$\theta = \mathrm{ArcCos}\left[\frac{Gz}{Gt}\right]$$

where the value for Gt is assumed to be known and not measured. Thus, the error of the inclination for Eq. 2 can be expressed as:

$$\delta\theta = \frac{-Gt}{\sqrt{Gt^2-Gz^2}}\delta\mathrm{Gz}$$

or $$\delta\theta = -\frac{\delta Gz}{\mathrm{Sin}[\theta]}$$

which is singular at θ=0. Hence, at small inclinations, small errors in Gz propagate into huge errors in θ.

If, in Eq. (2), individual measured values of $Gx^2+Gy^2+Gz^2$ are used (i.e. based on measurements of Gx, Gy and Gz), then the error can be expressed as $$\delta\theta = \frac{-1}{Goxy*Gt^2}(-Gz*Gx*\delta\mathrm{Gx} - Gz*Gy*\delta Gy + \delta Gz*Goxy^2)$$

Gx and Gy are related to the inclination and the gravitational tool face angle φ via the relations $$Gx=-Gt*\mathrm{Sin}[\theta]*\mathrm{Cos}[\phi]$$

$$Gy=Gt*\mathrm{Sin}[\theta]*\mathrm{Sin}[\phi]$$

Making suitable substitutions, the error is given by $$\delta\theta = \frac{-1}{Gt}(\mathrm{Cos}[\theta]*\mathrm{Cos}[\phi]*\delta Gx - \mathrm{Cos}[\theta]*\mathrm{Sin}[\phi]*\delta Gy + \delta Gz*\mathrm{Sin}[\theta])$$

Since the inclination θ is assumed to be very small, and retaining only first order terms, the equation for the error yields the following expression:

$$\delta\theta \sim \frac{-1}{Gt}(\mathrm{Cos}[\phi]*\delta Gx - \mathrm{Sin}[\phi]*\delta Gy)$$

This simplifies the previous formulation, and provides an accurate approximation of the error especially if measurements are made while the survey tool is stationary. If, however, measurements are made with a rotating or vibrating survey tool, the magnitudes of δGx/Gt and δGy/Gt can easily be on the order of 1 and often exceed 1, in which case the small angle approximation breaks down and it is clear that the inclination cannot be determined accurately. For most types of noise, performance can be enhanced by averaging the acceleration values or the derived inclinations, or by various types of filtering that are well known in the art. However, at small inclinations, and especially in situations where the measured inclination values are inputs to a control loop, the time needed for averaging and/or filtering may exceed the maximum allowable time between control commands. The azimuth at a point on a drill string is also undefined or unreliable if the drill string is positioned vertically or at low inclinations.

The objective of directional drilling is to control the inclination and azimuth of the drill string. It is therefore desired to provide a means of identifying the inclination and/or azimuth of the BHA 26 at low inclinations or a vertical position. The present disclosure provides instead of a mere inclination value, a range of possible inclination values and a probability associated with the inclination range. Similarly, the teaching of the disclosure can be used to provide a probability distribution of azimuth values or a range of possible azimuth values. The range of inclinations and azimuths can be used, with suitable weighting or steering parameters in the controller 30 to operate the drilling assembly 28 and steer the BHA in a desired direction.

At a given geographical location, the total magnetic field (Bt) as well as its vector components can be known from published data, or lacking that information, from direct measurements at the Earth's surface. Over the range covered by oil or gas wells, there is little variation in this field or its components. Where high accuracy is needed, means for accounting for this variation are well known, such as In-Field-Referencing (IFR), which takes crustal anomalies into account. Similarly, means for accounting for temporal variation in the field, referred to as IIFR (Interpolated In-Field Referencing) are well known. IIFR makes use of measurements at established magnetic observation sites to correct for time variation in the field.

The azimuth of the BHA may be calculated using an expression for the azimuth as function of the magnetic dip angle Δ, the inclination θ, the gravitational tool face angle φ, and a magnetic field parameter. For example, the cross-axial magnetic field component can be expressed as:

$$\frac{Boxy^2}{Bt^2} = \mathrm{Cos}[\Delta]^2*\mathrm{Sin}[\psi]^2 + (\mathrm{Cos}[\Delta]*\mathrm{Cos}[\theta]*\mathrm{Cos}[\psi] - \mathrm{Sin}[\Delta]*\mathrm{Sin}[\theta])^2$$

where the dip angle Δ of the Earth's magnetic field at a point on or near its surface is defined as the angle between the magnetic field lines and a horizontal reference plane, θ is the inclination, φ is the gravitational tool face angle, and ψ is the azimuth. Applying the total magnetic field Bt, the normalized cross-axial magnetic field is given by $$Boxyn = \frac{Boxy}{Bt}$$

which also yields the expression:

$$Boxyn^2 = \mathrm{Cos}\,[\Delta]^2*\mathrm{Sin}[\psi]^2 + (\mathrm{Cos}[\Delta]*\mathrm{Cos}[\theta]*\mathrm{Cos}[\psi] - \mathrm{Sin}[\Delta]*\mathrm{Sin}[\theta])^2$$

Thus, the expression for Boxyn can be rewritten to solve for the inclination or the azimuth as further described herein.

Figure 4:
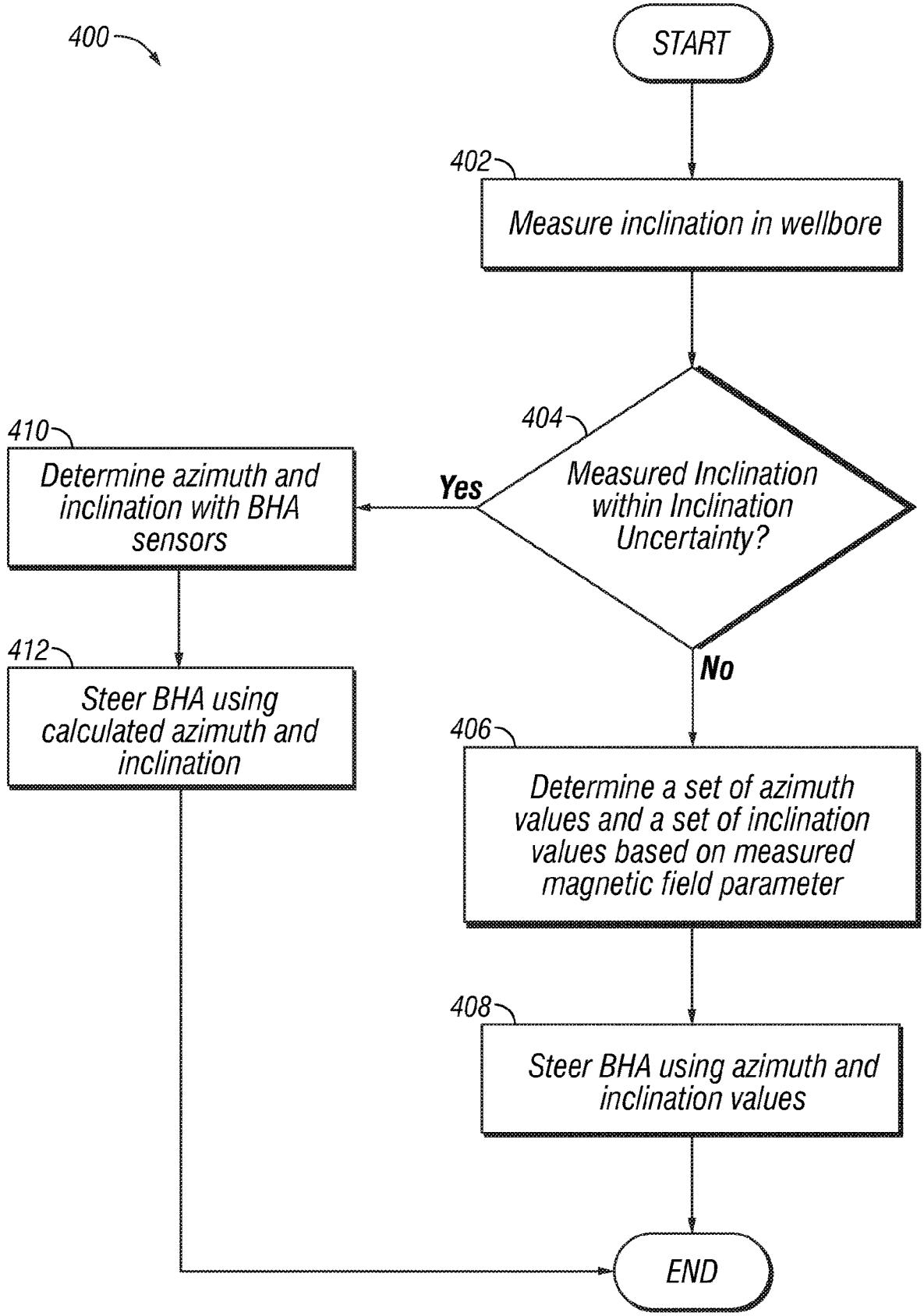
FIG. 4 depicts a flow chart of a method for steering the BHA, according to one or more embodiments.

FIG. 4 shows a flow chart view of a method for steering a BHA in a wellbore with a drilling assembly, in accordance with one or more embodiments. The sensors 34 monitor an orientation parameter and a magnetic field parameter such as the cross-axial magnetic field and may do so continually if desired. The orientation parameter may include an azimuth, a range of azimuth values, an inclination, a range of inclination values, an azimuth probability, and/or an inclination probability.

At block 402, the inclination of the BHA in the wellbore is measured using the gravitational field sensors 46. At block 404, the controller determines whether the measured inclination is within an inclination threshold representative of the inclination uncertainty. When the inclination exceeds the inclination uncertainty θc, control of the drilling assembly 28 is carried out using gravitational field measurements. When the inclination is less than the inclination uncertainty θc, the drilling assembly 28 is controlled based on the analysis of magnetic field parameters as discussed herein with respect to FIG. 5. The inclination of the BHA, which is measured using the gravitational field sensors 46, is unreliable and uncertain at low inclination values (e.g., ≤1.5°). The value of the inclination uncertainty may depend on the noise environment encountered in the wellbore as well as the BHA design. An inclination uncertainty of 1.5° may be suitable for some assemblies, while other BHAs may use an inclination uncertainty from 5° to 10° or more. If the measured inclination is within the inclination uncertainty (e.g., measured inclination≤inclination uncertainty threshold), the controller determines a set of azimuth values and a set of inclination values based on a measured magnetic field parameter, such as $Boxyn^2$ as previously discussed, at block 406. If the measured inclination is outside the inclination uncertainty, the controller determines the azimuth and inclination using the BHA sensors as previously described with respect to Eqs. 1 and 2. At block 408, the controller steers the BHA in a direction relative to the set of values for azimuth and inclination determined using the measured magnetic field parameter. Whereas, at block 412, the controller steers the BHA in a direction relative to the azimuth and inclination calculated at block 410.

Figure 5:
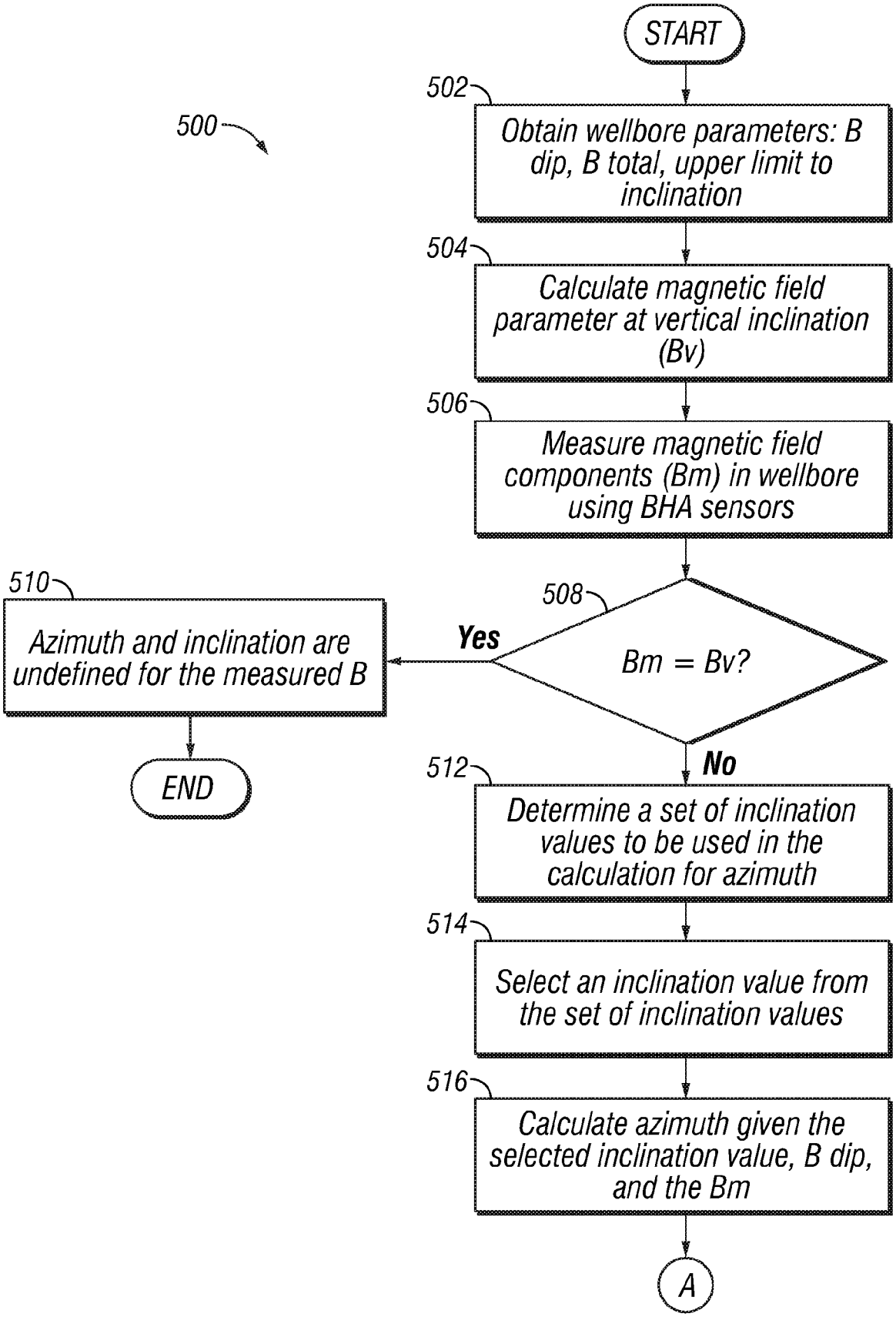
FIG. 5 depicts a flow chart of a method for determining a range of azimuths and inclinations of the BHA, according to one or more embodiments.
Figure 5:
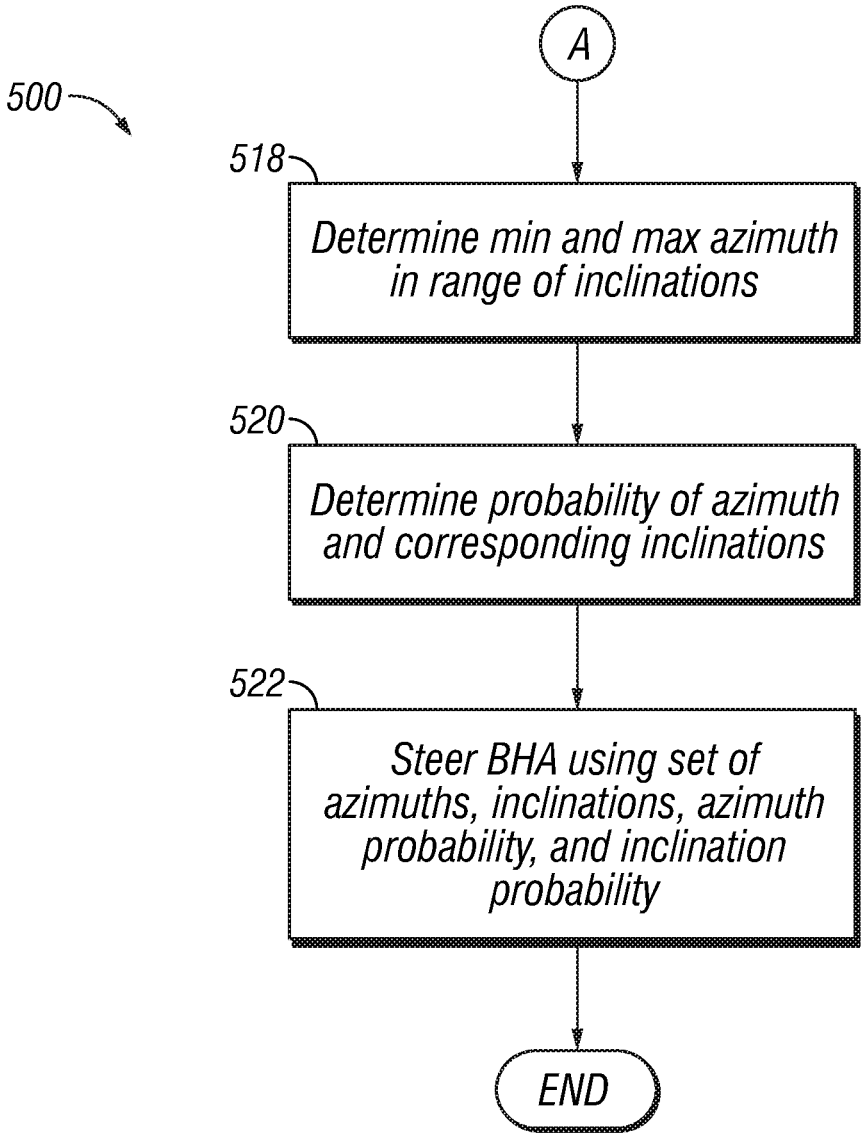

FIG. 5 shows a flow chart view of a method for determining an orientation parameter for a downhole tool using the measured magnetic field parameter, such as the BHA 26 of FIG. 1, using the measured magnetic field parameter, in accordance with one or more embodiments. At block 502, the method begins with identifying the known magnetic dip angle Δ at the well site and a threshold inclination value (also referred to herein as the inclination uncertainty θc). The inclination uncertainty is the value of inclination at which direct measurements of inclination can be made within a specified confidence interval and below which cannot be measured within a specified confidence interval. At block 504, the magnetic field parameter at a vertical inclination is calculated for checking whether a probability distribution can be determined for the measured magnetic field parameter. For example, the normalized value of $Boxyn^2$ is calculated given the magnetic dip angle and at an inclination of 0°. The value of the magnetic field parameter at an inclination of 0° is designated as Bv in FIG. 4. By is independent of azimuth and requires no downhole measurements (although magnetic field dip angle may be measured downhole as an alternative to using a known magnetic dip at the well site).

At block 506, the magnetic field sensors measure the Earth's magnetic field components in the wellbore and measure a magnetic field parameter designated as Bm in FIG. 4. Continuous measurements may be made of the magnetic field parameter Bm while drilling. Continuous measurements refers to discrete measurements at a constant rate or at pre-specified depth intervals that are short with respect to changes in drilling parameters such as depth, inclination or azimuth. The magnetic field parameter values may also be processed over a given number of samples representing a given time or spatial interval. The time or spatial interval may be selected such that the expected changes in inclination and azimuth are negligible over the selected interval. The processing of the magnetic field measurements may include rejecting values that have a low signal to noise ratio (e.g. values that exceed the known value of the total magnetic field) or may include averaging and/or filtering, such as low or bandpass filtering. The processed magnetic field measurements yield a magnetic field parameter representative of the inclination and azimuth, such as a value of Boxy or $Boxy^2$ normalized to the local magnitude of the local magnetic field to be used in the analysis ($Boxyn^2$). The normalization to the magnitude of the local magnetic field is not required, but is simply preferred to provide a standard for the analysis.

At block 508, the controller determines whether the measured magnetic field parameter Bm matches the calculated magnetic field parameter at a vertical inclination By. In the unlikely case that Bm is equal to Bv, the BHA is in a vertical position and the azimuth is designated as being undefined at block 510. Otherwise, the value of the magnetic field parameter is compatible with identifying a range of inclinations and azimuths.

At block 512, a set of constraints on the inclination (e.g., a minimum value and a maximum value) are selected for the inclination values to be used in the calculation for the azimuth. For example, a value of 0° may be selected for the minimum inclination. The minimum inclination may also be determined by solving a quadratic or via an iterative solution method. In order to calculate probabilities, the values of inclination may include a lower constraint $\theta_1$, an upper constraint $\theta_2$, and the inclination uncertainty $\theta_c$. The lower constraint $\theta_1$ is the lower value of inclination for the interval over which probabilities are to be calculated, and the upper constraint $\theta_2$ is the upper value of inclination. The number of inclination values to be included between $\theta_1$ and $\theta_2$ or $\theta_c$ may be sufficient to allow probabilities to be calculated within a suitable precision using techniques understood by one skilled in the art. The inclination constraints, θc, $\theta_1$, $\theta_2$ may be user-specified when the BHA is at the Earth's surface, pre-programmed into the controller 30, or received by the controller in the wellbore via a telemetry downlink.

At block 514, an inclination value from the lower inclination to the upper inclination is selected to solve for the azimuth. At block 516, the azimuth is solved using an expression for the azimuth given the selected inclination θ, magnetic field dip angle Δ, and the magnetic field parameter $B_m$. For example, one of the following expressions may be used to determine the azimuth based on the cross-axial magnetic field parameter $Boxyn^2$:

$$\psi = \mathrm{ArcCos}\left[-\mathrm{Tan}[\Delta]\mathrm{Cot}[\theta] + \frac{\sqrt{1 - Boxyn^2}}{\mathrm{Cos}[\Delta]\mathrm{Sin}[\theta]}\right] \tag{3}$$

$$\psi = \mathrm{ArcCos}\left[-\mathrm{Tan}[\Delta]\mathrm{Cot}[\theta] - \frac{\sqrt{1 - Boxyn^2}}{\mathrm{Cos}[\Delta]\mathrm{Sin}[\theta]}\right] \tag{4}$$

where Eq. (3) is applied if $Boxyn^2$ exceeds $B_v$ and the magnetic field dip angle is positive or if $Boxyn^2$ is below $B_v$ and the magnetic field dip angle is negative. Otherwise, Eq. (4) is applied to solve for the azimuth. If the selected inclination value results in the argument of the ArcCos used to calculate ψ being less than −1 or greater than 1, no solution is possible for the azimuth at that inclination, and the selected inclination is discarded. Otherwise, another inclination value is selected from the set of inclination values from $\theta_1$ to $\theta_2$ or $\theta_c$ to calculate an azimuth corresponding to that inclination.

Figure 6A:
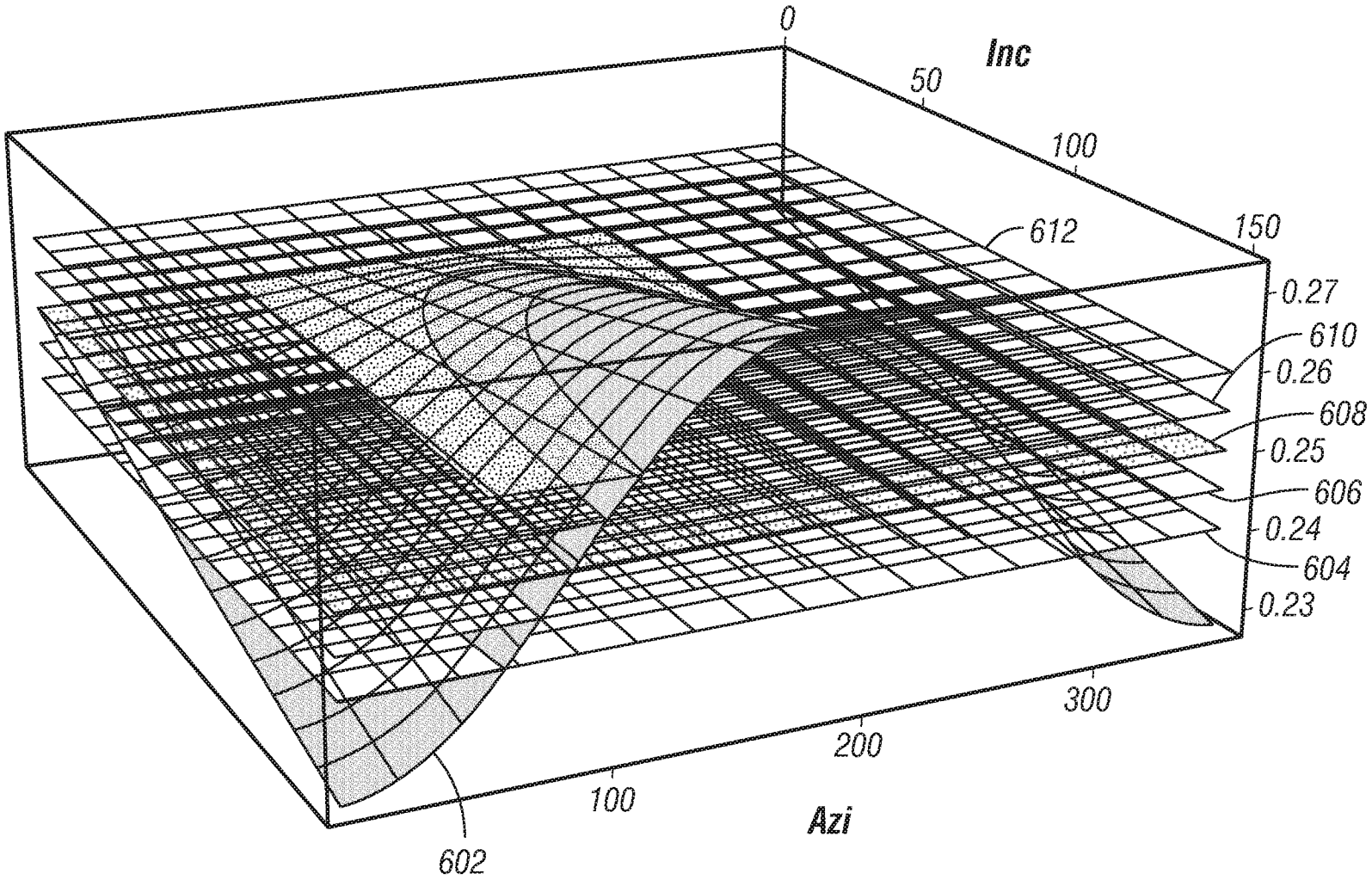
FIGS. 6A and B depict graphs of cross-axial magnetic field as a function of azimuth and inclination, according to one or more embodiments.
Figure 6B:
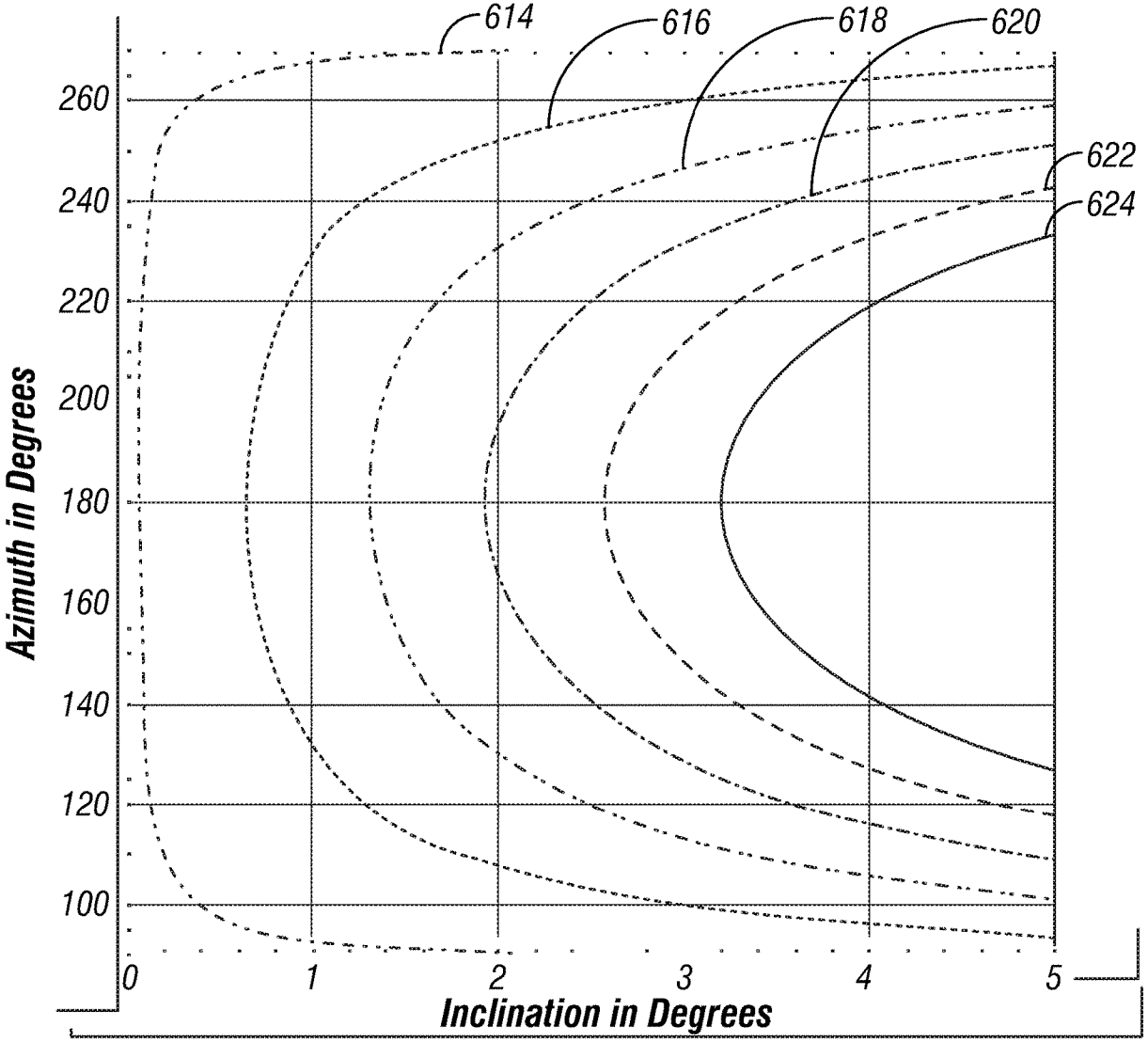

For example, FIGS. 6A and 6B show graphs of the cross-axial magnetic field parameter (Boxyn) plotted as a function azimuth and inclination. As shown in FIG. 6A, the horse saddle shaped surface 602 is the magnetic field parameter (Boxyn) for a dip angle of 60° solved as a function of inclination and azimuth. The vertical axis corresponds to values of $Boxyn^2$, while the x-axis labeled "Inc" shows inclination in units of 0.01 degrees, and the y-axis labeled Azi shows the azimuth in units of degrees. The surface of $Boxyn^2$ 602 is plotted for values of inclination from 0-1.5° and azimuths from 0-360°. At an inclination of 0° there is no azimuthal dependence, whereas the azimuthal dependence continues to grow as the inclination increases. The horizontal plane 608 contains the intersection within an inclination of 0° and corresponds to a $Boxyn^2$ value of 0.25. Four other horizontal planes 604, 606, 610, and 612 of various $Boxyn^2$ values are shown representing: 0.24, 0.245, 0.255, and 0.26, respectively.

As shown in FIG. 6B, various values of $Boxyn^2$ are plotted as functions of azimuth and inclination for a dip angle of 60° in a two axis plot. Each curve 614-624 depicts a separate value of $Boxyn^2$ (0.251, 0.26, 0.27, 0.28, 0.29, 0.30, respectively) as a function of azimuth and inclination. Thus, FIG. 6B provides an alternative illustration of the $Boxyn^2$ values depicted in FIG. 6A.

Suppose a value of $Boxyn^2$ has been measured to be 0.26, and the measured inclination is within an inclination uncertainty (e.g., ≤1°). As shown in FIG. 6A, the range of possible inclinations and azimuths is limited to the intersection of the horizontal plane 612 and the surface 602. Likewise in FIG. 6B, the range of possible inclinations and azimuths for a measured $Boxyn^2$ value of 0.26 is depicted by curve 616. FIG. 6B shows that the inclination cannot be less than the lowest value of inclination along the curve 616; nor can the inclination be more than the assumed upper limit, e.g., $\theta_2$ or $\theta_c$. Thus, the inclination ranges from about 0.8° to about 1° for the $Boxyn^2$ value of 0.26. Similarly, the azimuth for a $Boxyn^2$ value of 0.26 is constrained by the upper limit for inclination and ranges from about 130° to 230°.

Referring to FIG. 5, at the first valid solution in looping over the proposed inclination values, the azimuth corresponding to that inclination is compared either with π for Eq. 3 or with 0 for Eq. 4. The azimuth must take on one of these values at the smallest inclination according to the solution branch of the equation (Eg. 3 or 4). If the azimuth differs from one of these values by more than a specified value (ΔΨmax), the selected inclination resolution is inadequate and must be reduced or increased. The value of ΔΨmax is the desired resolution for the calculated azimuth range, and should provide a sufficient resolution on azimuth that the accuracy of the probability computation is not compromised. Once the desired resolution is achieved, processing can continue until azimuths have been determined for the entire range of inclinations. In practice, the interval between inclination values need not be constant. For example, the step size between progressive inclination values can be increased or decreased as the azimuth increases. At block 518, once the relations between inclination and azimuth have been determined, the corresponding range of azimuths can be output as the achievable range of azimuths for the selected inclinations.

At block 520, the probability of obtaining an inclination from $\theta_1$ to $\theta_2$ and the corresponding azimuths can be determined. If no information is available on the form of the statistical distribution of azimuths, it should be assumed that the azimuths are uniformly distributed. Quantitative inferences can be made about the inclination and the azimuth based on the observed value of the magnetic field parameter such as Boxyn. For example, at extremely small inclinations, it is reasonable to assume that the azimuth, poorly defined at best, is close to a uniformly distributed random variable. The range of achievable azimuths can be obtained from solving for azimuth given the selected inclination θ, magnetic field dip angle Δ, and the magnetic field parameter $B_m$.

Let p[ψ] be the differential probability distribution of the azimuth ψ, i.e. the probability of obtaining a specific value of azimuth in an infinitesimal increment of azimuth δψ is given by p[ψ]δψ. Similarly, Let t[θ] be the differential probability distribution of the inclination having a value of θ. If $\theta_p$ is a particular value of θ, there are two values of ψ that will correspond to that value of θ and will be distributed symmetrically around 180° (π in radian measure).

Defining the value of ψ<π that corresponds to $\theta_p$ as $\psi_p$, the probability density is given by $$t[\theta p]\delta\theta p = p[\psi p]\delta\psi p$$

Hence, the probability that θ is between two values, θ1 and θ2, is given by $$T[\theta 1, \theta 2] \equiv \int_{\theta 1}^{\theta 2} t[\theta] d\theta$$

The probability of the inclination can be rewritten as $$T[\theta 1, \theta 2] = \int_{\psi[\theta 1]}^{\psi[\theta 2]} p[\psi] d\psi$$

where ψ[θ2] is the value of ψ corresponding to θ2 in the interval from π to 2π. If it is assumed that ψ is uniformly distributed between the allowed values $\psi_{max}$ and $\psi_{min}$ (where $\psi_{max}$ is the maximum value from the allowable values >π and $\psi_{min}$ is the minimum value from the allowable values<π), the probability of the inclinations is as follows:

$$T[\theta 1, \theta 2] = \frac{\psi[\theta 2] - \psi[\theta 1]}{\psi \max - \psi \min}$$

The probability has been formulated in this way because there are two values of inclination corresponding to every value of azimuth. More practically, since it is necessary that θ2=2π−θ1, the probability of the inclination can be reduced to $$T[\theta 1] = \frac{\pi - \psi[\theta 1]}{\pi - \psi \min}$$

Where the argument θ2 of T has been dropped since it is no longer needed.

Referring to FIG. 6B, with a dip of 60° and an observed value of $Boxyn^2$ is 0.251, and assuming the inclination uncertainty is no more than 1.5°, the acceptable inclination and azimuth values are depicted along curve 614. In that case, the smallest possible inclination is 0.065°, the allowable azimuth range is 91.2° to 268.8°, and the probability that the inclination is between 0.065° and 0.5° is 0.933. If, on the other hand, the observed $Boxyn^2$ is 0.26, the inclination must be at least 0.66° and the azimuth ranges between 115° and 245°. Assuming that the inclination uncertainty is no more than 1.5°, the probability that the inclination is between 1.0° and 1.5° is found to be 0.76 (At 1°, the azimuth is 130.2° or 229.8° when the inclination is 1°, and the azimuth is 114.5° or 244.5° at 1.5°).

At block 522, the controller 30 uses the set of available azimuths, inclinations, the azimuth probability, the inclination probability, or a combination thereof to steer the BHA in a desired direction within the measured orientation parameters or relative to the measured orientation parameters. For example, the controller 30 operates the drilling assembly 28 to drill the wellbore in the desired direction relative to the measured orientation parameters and achieve a planned wellbore trajectory. The inclination and azimuth desired for the present location of the BHA may be predetermined and available to the controller 30 to steer the BHA in the desired direction along the wellbore trajectory using the set of available azimuths, inclinations, the azimuth probability, and the inclination probability. Also, often when "kicking off" at low inclinations, little or no azimuthal information is available. When the inclination is at or below the value for the inclination uncertainty, the operator may utilize the method of determining the orientation parameters based on the magnetic field as previously described to narrow the range of allowable azimuths given the inclination and its probability.

As an example, if the drilling program calls for maintaining the inclination at a value from $\theta_1$ to $\theta_2$, the controller 30 determines the probability (Pab) that the inclination is from $\theta_1$ to $\theta_2$ using the method previously described. If the probability $P_{ab}$ exceeds an acceptable threshold (e.g., >0.5) and the planned azimuth is within the range of calculated azimuths, the controller may hold the course of the BHA. If the probability Pab exceeds the acceptable threshold, but the planned azimuth is not within the range of calculated azimuths, the controller 30 instructs the drilling assembly 28 to orient the shaft (for a point the bit system) or change the pads (for a push the bit system) so as to steer the BHA in the direction that will bring the BHA to the desired azimuth (i.e., either clockwise or counter-clockwise).

If the probability $P_{ab}$ that the inclination is between from $\theta_1$ to $\theta_2$ is less than an acceptable threshold, the controller 30 calculates the probability $P_{bc}$ that the inclination is from $\theta_2$ and $\theta_c$, and thus, the probability $P_{ma}$ that the inclination is from the theoretical minimum inclination to $\theta_1$ is $1-P_{ab}-P_{bc}$.

When considering whether the three probabilities ($P_{ab}$, $P_{bc}$, or $P_{ma}$) are greater than, equal to or less than in comparative relations, there are 27 combinations, 14 of which are self-contradictory. For completeness, all 27 combinations are listed below, along with a possible action to be taken under each probability condition.

| Condition | Possible Action |
|---|---|
| (Pma < Pab) && (Pma < Pbc) && (Pab < Pbc) | Activate mechanism to decrease inclination |
| (Pma = Pab) && (Pma <Pbc) && (Pab < Pbc) | Activate mechanism to decrease inclination |
| (Pma > Pab) && (Pma < Pbc) && (Pab < Pbc) | Activate mechanism to decrease inclination |
| (Pma < Pab) && (Pma = Pbc) && (Pab < Pbc) | Impossible condition |
| (Pma = Pab) && (Pma = Pbc) && (Pab < Pbc) | Impossible condition |
| (Pma > Pab) && (Pma = Pbc) && (Pab < Pbc) | Hold inclination |
| (Pma < Pab) && (Pma > Pbc) && (Pab < Pbc) | Impossible condition |
| (Pma = Pab) && (Pma > Pbc) && (Pab < Pbc) | Impossible condition |
| (Pma > Pab) && (Pma > Pbc) && (Pab < Pbc) | Activate mechanism to increase inclination |
| (Pma < Pab) && (Pma < Pbc) && (Pab = Pbc) | Hold inclination |
| (Pma = Pab) && (Pma < Pbc) && (Pab = Pbc) | Impossible condition |
| (Pma > Pab) && (Pma < Pbc) && (Pab = Pbc) | Impossible condition |
| (Pma < Pab) && (Pma = Pbc) && (Pab = Pbc) | Impossible condition |
| (Pma = Pab) && (Pma = Pbc) && (Pab = Pbc) | Hold inclination |
| (Pma > Pab) && (Pma = Pbc) && (Pab = Pbc) | Impossible condition |
| (Pma < Pab) && (Pma > Pbc) && (Pab = Pbc) | Impossible condition |
| (Pma = Pab) && (Pma > Pbc) && (Pab = Pbc) | Impossible condition |
| (Pma > Pab) && (Pma > Pbc) && (Pab = Pbc) | Activate mechanism to decrease inclination |
| (Pma < Pab) && (Pma < Pbc) && (Pab > Pbc) | Hold inclination |
| (Pma = Pab) && (Pma < Pbc) && (Pab > Pbc) | Impossible condition |
| (Pma > Pab) && (Pma < Pbc) && (Pab > Pbc) | Impossible condition |
| (Pma < Pab) && (Pma = Pbc) && (Pab > Pbc) | Hold inclination |
| (Pma = Pab) && (Pma = Pbc) && (Pab > Pbc) | Impossible condition |
| (Pma > Pab) && (Pma = Pbc) && (Pab > Pbc) | Impossible condition |
| (Pma < Pab) && (Pma > Pbc) && (Pab > Pbc) | Hold inclination |
| (Pma = Pab) && (Pma > Pbc) && (Pab > Pbc) | Hold inclination |
| (Pma > Pab) && (Pma > Pbc) && (Pab > Pbc) | Activate mechanism to increase inclination |

With sufficient data, the probability distribution of the measured magnetic field value, such as the cross-axial component Boxy, may be determined to incorporate into the probability analysis of the inclination. Using the general principles previously discussed related to the probability distribution of the inclination, it is possible to modify the probability analysis to take into account the probability distribution of the measured magnetic field parameter, such as Boxy. It is therefore possible to determine confidence bounds on Pma, Pab and Pbc. Thus, it is possible to carry out hypothesis testing on Pma, Pab and Pbc. For example, the controller 30 can test a hypothesis that Pma=Pab or Pab>Pbc to a specified level of confidence. This makes it possible (with a specified confidence) to resolve any ambiguities in the decision table provided above, such as when probabilities are equal to each other.

Depending on the specific design of the drilling assembly 28, the values of Pma, Pab and Pbc along with the statistical distribution of these probabilities (or parameters related to the distribution, such as variance) may be used as inputs to the controller 30 to steer the BHA 26. For example, if there is a high probability that the BHA 26 should increase its inclination, but the confidence associated with the decision to do so is low, the controller 30 may weigh the input that increases inclination by the confidence associated with the decision.

The controller 30 may also use weighted values of Pma, Pab and Pbc as inputs for the probabilities. In addition, the controller 30 may identify trends in the inclination probability as the magnetic field is continuously measured. For example, if n observations of Boxy are made at times $t_i$ (i=1, n) and at each value of i there is a probability $p_i$ with a confidence $C_i$ that the inclination is greater than the desired inclination. It may be that there is an increasing trend in the $p_i$ values or there is an increasing trend in the $p_i$ values weighted with the $C_i$ values. Using statistical techniques or, for example using a Kalman filter, it may be possible to project with a certain confidence that after m samples (m>n), when considered with $C_m$, the controller 30 can confidently identify that $p_m$ exceeds the threshold specified for a decision to decrease the inclination angle according to a planned wellbore trajectory. In this case, course corrections can be applied earlier than they would have without the Kalman filter. Clearly many other such suitable models for the probability can be applied within the spirit of this disclosure.

It can be seen from this disclosure that considerable information is available about the inclination and the azimuth through a knowledge of the dip angle, the value of a magnetic field parameter (e.g., $Boxyn^2$), and a lower limit on the inclination. The examples depicted in FIGS. 6A and B are for cases where the dip angle is positive and where the observed value of $Boxyn^2$ exceeded the vertical inclination value Bv.

The measured magnetic field parameter may exhibit noise, especially if the measurement is made while drilling. Generally, the noise can be reduced to an acceptable level through taking of multiple samples, averaging, and digital filtering. It may turn out, however, that for example within a standard deviation of the noise in $Boxyn^2$, there is significant variation in the range of achievable azimuths, or within the allowable inclinations and the probabilities that the inclination is between two specified values. Assuming that the noise statistics are stationary, the distribution of noise in $Boxy^2$ can be determined by keeping a record (preferably in the downhole tool) of observed $Boxyn^2$ values. In this case, the probability of the inclination being within a given range can be calculated over a plurality of values of $Boxyn^2$, and an expected value of the probability may be calculated as a weighted sum taking into account the probabilities of the selected values of $Boxyn^2$. For some distributions, it should be possible to carry this out analytically, but in the general case, the calculation should be carried out numerically. This can also be applied to the range of allowable azimuth values.

It should be appreciated that a similar analysis to that used with cross-axial component Boxy can be carried out with Bz, the component of the magnetic field along the drill string axis, to determine the range of azimuths, inclinations, and corresponding probabilities Bz as normalized by Bt, which is given by $$Bzn=\mathrm{Sin}[\theta]*\mathrm{Cos}[\psi]*\mathrm{Cos}[\Delta]+\mathrm{Cos}[\theta]*\mathrm{Sin}[\Delta]$$

Essentially, the same type of analysis can be conducted as with the Boxyn surface discussed with respect to FIGS. 4 and 5. The magnetic field parameter may include a cross-axial component of the magnetic field or an axial component of the magnetic field. For small inclination values, using Bzn is fully equivalent to the Boxyn analysis and produces the same solutions. At very large angles (inclinations of 90° or more), or in regions where Bzn can change sign, there is some added information that helps reduce the uncertainty as to which branch to take when selecting a solution. It should be noted, however, that Bz is more likely to be corrupted with noise that cannot be simply removed by filtering or data selection.

Figure 7A:
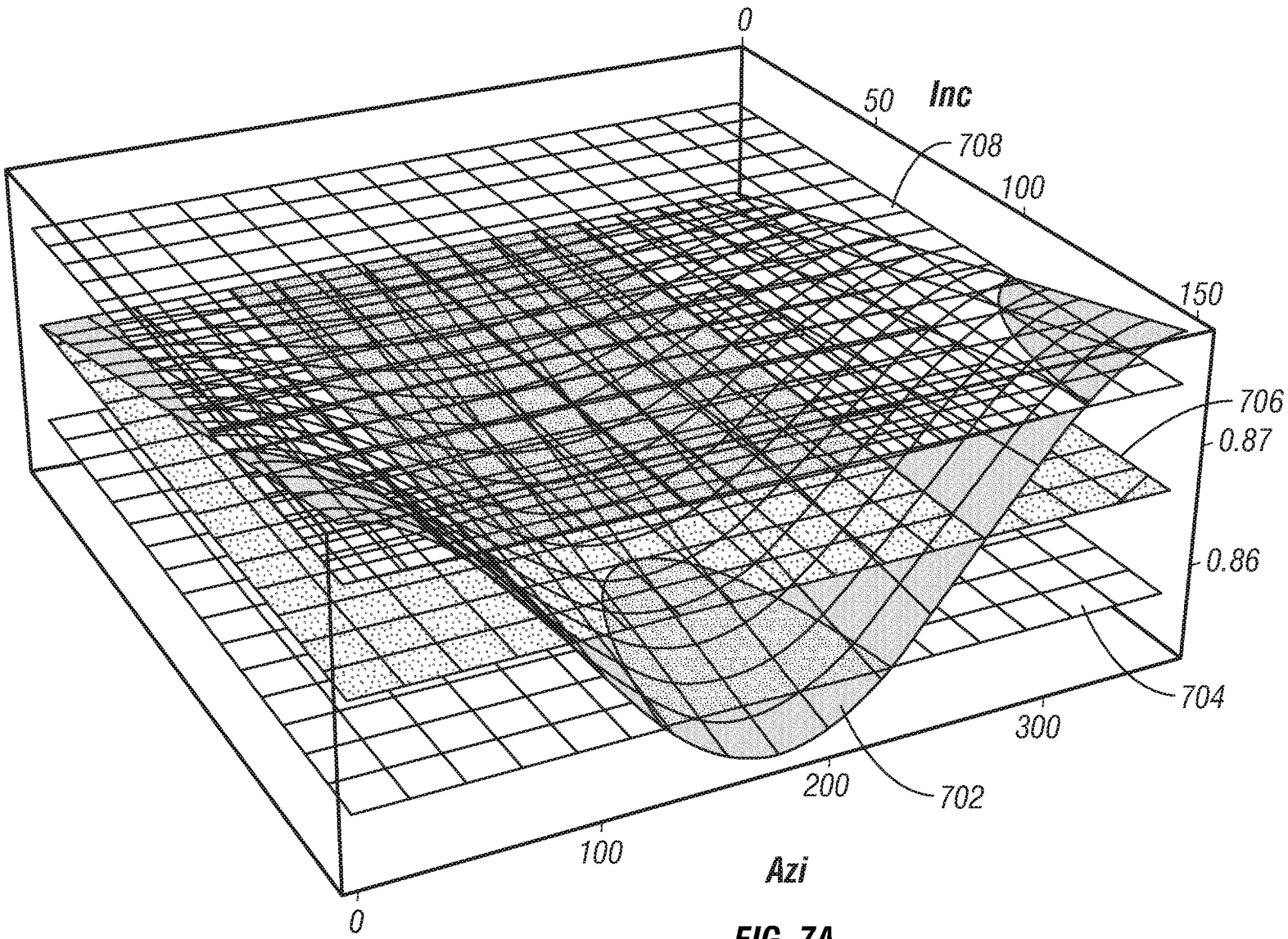
FIGS. 7A and B depict graphs of the vertical magnetic field as a function of azimuth and inclination, according to one or more embodiments.
Figure 7B:
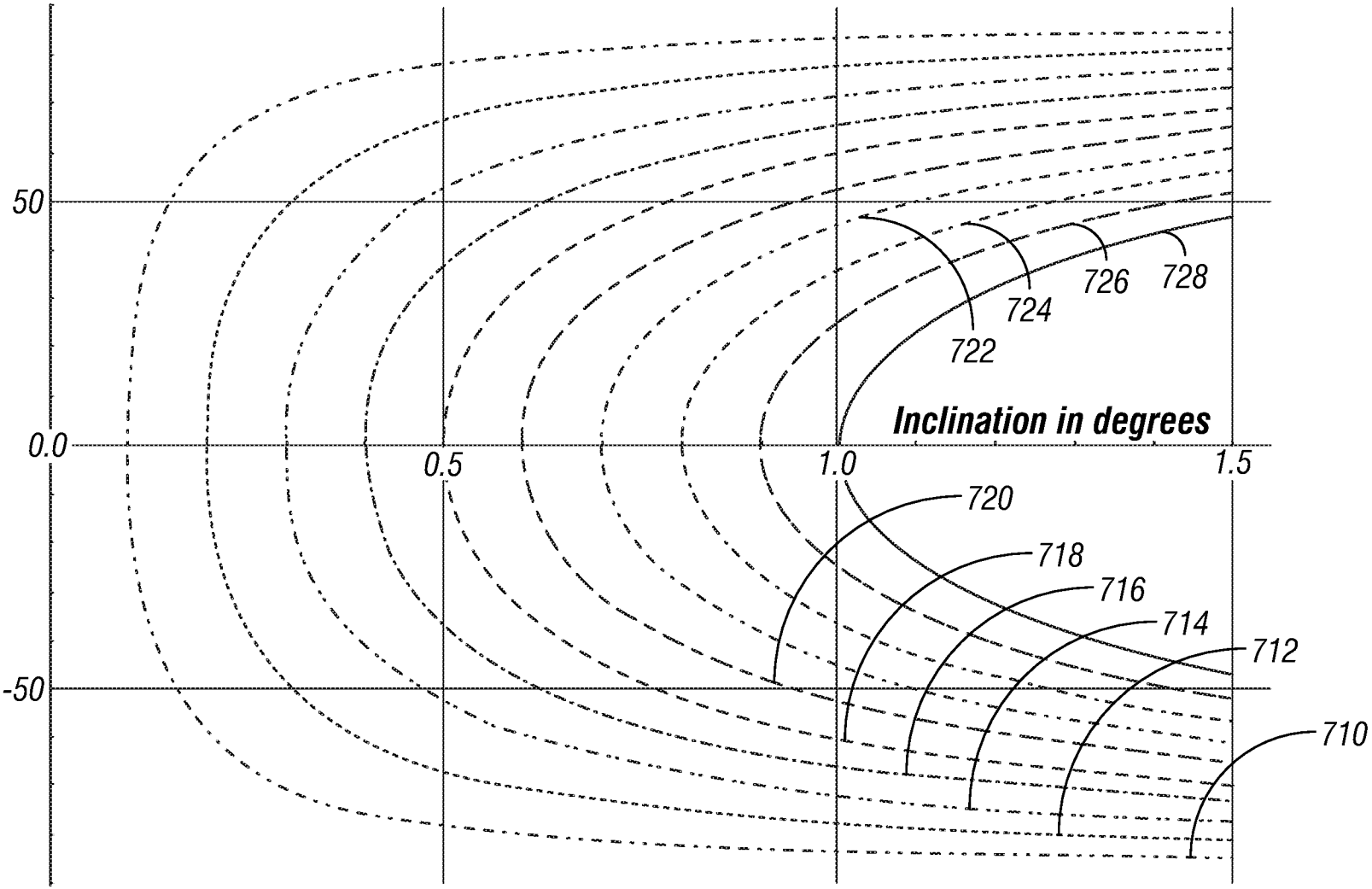

FIGS. 7A and B show graphs of the vertical magnetic field parameter (Bzn) plotted as a function azimuth and inclination. As shown in FIG. 7A, the concave surface 702 is the magnetic field parameter (Bzn) for a dip angle of 60° solved as a function of inclination and azimuth. The vertical axis corresponds to values of Bzn, while the x-axis labeled "Inc" shows inclination in units of 0.01 degrees, and the y-axis labeled Azi shows the azimuth in units of degrees. The horizontal plane 706 contains the intersection within an inclination of 0° and corresponds to a Bzn value of 0.866. Two other horizontal planes 604 and 610, of Bzn values are shown representing: 0.857 and 0.875 respectively. As shown in FIG. 7B, various values of Bzn are plotted as functions of azimuth and inclination for a dip angle of 60° in a two axis plot. Each curve 710-728 depicts a separate value of Bzn (1.001, 1.002, 1.003, 1.004, 1.005, 1.006, 1.007, 1.008, 1.009, 1.010, respectively) as a function of azimuth and inclination. Thus, FIG. 7B provides an alternative illustration of the Bzn values depicted in FIG. 7A.

In addition to the embodiments described above, many examples of specific combinations are within the scope of the disclosure, some of which are detailed below:

Example 1

A downhole tool connectable to a tubing in a wellbore, comprising:

a magnetic field sensor operable to measure a magnetic field parameter in the wellbore; and a controller operable to determine an orientation parameter for the downhole tool located in the wellbore using the magnetic field parameter, a dip angle for the magnetic field parameter, and a selected inclination value.

Example 2

The tool of example 1, wherein the orientation parameter comprises an azimuth or an inclination of the downhole tool.

Example 3

The tool of example 1, wherein the controller is further operable to control a drilling assembly to steer the downhole tool in the wellbore in a direction relative to the orientation parameter.

Example 4

The tool of example 1, wherein the magnetic field parameter comprises cross-axial magnetic field components or a vertical magnetic field component.

Example 5

The tool of example 1, wherein the orientation parameter comprises more than one azimuth or more than one inclination of the downhole tool.

Example 6

The tool of example 1, wherein the controller is further operable to determine a probability for the downhole tool to be oriented in a direction of the orientation parameter.

Example 7

The tool of example 1, further comprising a gravitational field sensor operable to measure an inclination in the wellbore, wherein the controller is further operable to determine the orientation parameter by in part calculating the orientation parameter based on the magnetic field parameter, the dip angle for the magnetic field parameter, and the selected inclination value if the measured inclination is below a threshold inclination.

Example 8

The tool of example 7, wherein the threshold inclination is 1.5°.

Example 9

The tool of example 7, wherein the threshold inclination is from 5° to 10°.

Example 10

The tool of example 1, wherein the controller is further operable to determine the orientation parameter by determining values for azimuth and inclination of the downhole tool as a function of the magnetic field parameter.

Example 11

A method, comprising:

measuring a magnetic field parameter in the wellbore using a magnetic field sensor;

determining an orientation parameter for a downhole tool located in the wellbore using the magnetic field parameter and a dip angle for the magnetic field parameter.

Example 12

The method of example 11, wherein the orientation parameter comprises an azimuth or an inclination of the downhole tool.

Example 13

The method of example 11, further comprising steering the downhole tool in the wellbore in a direction relative to the orientation parameter.

Example 14

The method of example 11, wherein the magnetic field parameter comprises cross-axial magnetic field components or a vertical magnetic field component.

Example 15

The method of example 11, wherein the orientation parameter comprises more than one azimuth value or more than one inclination value of the downhole tool.

Example 16

The method of example 11, further comprising determining a probability for the downhole tool to be oriented in a direction of the orientation parameter.

Example 17

The method of example 11, wherein determining the orientation parameter comprises calculating the orientation parameter based on the magnetic field parameter, the dip angle for the magnetic field parameter, and a selected inclination value.

Example 18

The method of example 11, further comprising:

measuring an inclination in a wellbore using a gravitational field sensor;

identifying that the measured inclination is below a threshold inclination; and wherein determining the orientation parameter comprises calculating the orientation parameter based on the magnetic field parameter, the dip angle for the magnetic field parameter, and the selected inclination value if the measured inclination is below a threshold inclination.

Example 19

The method of example 11, wherein the threshold inclination is 1.5°.

Example 20

A system, comprising:

a tubing locatable in a wellbore;

a downhole tool connectable to the tubing in the wellbore, the downhole tool comprising:

a magnetic field sensor operable to measure a magnetic field parameter in the wellbore; and a controller operable to determine an orientation parameter using the magnetic field parameter, a dip angle for the magnetic field parameter, and a selected inclination value.

This discussion is directed to various embodiments of the present disclosure. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A downhole tool connectable to a tubing in a wellbore, comprising:

a magnetic field sensor operable to measure a magnetic field parameter in the wellbore; and a controller operable to determine an orientation parameter for the downhole tool located in the wellbore using the magnetic field parameter, a dip angle for the magnetic field parameter, and a selected inclination value for the downhole tool selected from a selected set of constraints.

2. The tool of claim 1, wherein the orientation parameter comprises an azimuth or an inclination of the downhole tool.

3. The tool of claim 1, wherein the controller is further operable to control a drilling assembly to steer the downhole tool in the wellbore in a direction relative to the orientation parameter.

4. The tool of claim 1, wherein the magnetic field parameter comprises cross-axial magnetic field components or a vertical magnetic field component.

5. The tool of claim 1, wherein the orientation parameter comprises more than one azimuth or more than one inclination of the downhole tool.

6. The tool of claim 1, wherein the controller is further operable to determine a probability for the downhole tool to be oriented in a direction of the orientation parameter.

7. The tool of claim 1, further comprising a gravitational field sensor operable to measure an inclination of the downhole tool in the wellbore, wherein the controller is further operable to determine the orientation parameter by in part calculating the orientation parameter based on the magnetic field parameter, the dip angle for the magnetic field parameter, and the selected inclination value if the measured inclination is below a threshold inclination.

8. The tool of claim 7, wherein the threshold inclination is 1.5°.

9. The tool of claim 7, wherein the threshold inclination is from 5° to 10°.

10. The tool of claim 1, wherein the controller is further operable to determine the orientation parameter by determining values for azimuth and inclination of the downhole tool as a function of the magnetic field parameter.

11. A method, comprising:

measuring a magnetic field parameter in a wellbore using a magnetic field sensor;

determining an orientation parameter for a downhole tool located in the wellbore using the magnetic field parameter, a dip angle for the magnetic field parameter, and a selected inclination value for the downhole tool selected from a selected set of constraints; and steering the downhole tool in the wellbore in a direction relative to the orientation parameter.

12. The method of claim 11, wherein the orientation parameter comprises an azimuth or an inclination of the downhole tool.

13. The method of claim 11, wherein the magnetic field parameter comprises cross-axial magnetic field components or a vertical magnetic field component.

14. The method of claim 11, wherein the orientation parameter comprises more than one azimuth value or more than one inclination value of the downhole tool.

15. The method of claim 11, further comprising determining a probability for the downhole tool to be oriented in a direction of the orientation parameter.

16. The method of claim 11, wherein determining the orientation parameter comprises calculating the orientation parameter based on the magnetic field parameter, the dip angle for the magnetic field parameter, and the selected inclination value.

17. The method of claim 11, further comprising:

measuring an inclination of the downhole tool in the wellbore using a gravitational field sensor;

identifying that the measured inclination is below a threshold inclination, and wherein determining the orientation parameter comprises calculating the orientation parameter based on the magnetic field parameter, the dip angle for the magnetic field parameter, and the selected inclination value if the measured inclination is below a threshold inclination.

18. The method of claim 11, wherein the threshold inclination is 1.5°.

19. A system, comprising:

a tubing locatable in a wellbore;

a downhole tool connectable to the tubing in the wellbore, the downhole tool comprising:

a magnetic field sensor operable to measure a magnetic field parameter in the wellbore; and a controller operable to determine an orientation parameter using the magnetic field parameter, a dip angle for the magnetic field parameter, and a selected inclination value for the downhole tool selected from a selected set of constraints.

* * * * *